US005378192A

United States Patent [19]

Darmante

[11] Patent Number: 5,378,192

[45] Date of Patent: Jan. 3, 1995

[54] CUSTOM-FIT FRONT-OPENING BRASSIERE

[76] Inventor: Dale T. Darmante, 2 Horizon Rd., Fort Lee, N.J. 07024

[21] Appl. No.: 130,866

[22] Filed: Oct. 4, 1993

[51] Int. Cl.[6] ..... A41C 3/02

[52] U.S. Cl. ..... 156/58; 450/70; 450/79; 2/73; 2/106

[58] Field of Search ..... 2/67, 73, 109, 110, 2/105, 106; 450/30, 58, 66, 70, 79, 80, 82, 83, 84, 85, 91

[56] References Cited

U.S. PATENT DOCUMENTS

| | | | |
|---|---|---|---|
| 1,237,060 | 8/1917 | Kops | 450/58 |
| 2,390,465 | 12/1945 | Russo | 450/58 |
| 3,066,676 | 12/1962 | Kaupp | 450/58 |
| 3,378,013 | 4/1968 | Bruno | 450/58 |
| 4,909,771 | 3/1990 | Bergman | 450/66 X |
| 4,955,846 | 9/1990 | Greenberg | 2/73 |
| 5,180,326 | 1/1993 | Williams | 450/31 X |

FOREIGN PATENT DOCUMENTS

| | | | |
|---|---|---|---|
| 1257526 | 2/1961 | France | 450/86 |

*Primary Examiner*—Jeanette E. Chapman
*Attorney, Agent, or Firm*—Kirschstein, Ottinger, Israel and Schiffmiller

[57] ABSTRACT

A one-piece, front-opening brassiere has independently adjustable front panels accessible solely from the front of the brassiere, to provide a custom fit especially useful during athletic activities.

8 Claims, 3 Drawing Sheets

CUSTOM-FIT FRONT-OPENING BRASSIERE

BACKGROUND OF THE INVENTION

1. Field of the Invention

This invention generally relates to brassieres and, more particularly, to sports brassieres intended to stabilize a wearer's breasts during athletic activities.

2. Description of the Related Art

Sports brassieres intended to restrain a wearer's breasts during vigorous bodily movements are typically so-called "pullovers" made of a stretchable, elastic fabric. In order to stabilize the breasts against excessive bounce and sway during athletic activities, such brassieres tend to be tight-fitting and, hence, such brassieres tend to tightly bind and flatten the breasts in a band-like manner. Due to the tight fight, such brassieres are somewhat awkward to pull over one's head.

In any event, many wearers find such tight-fitting pullovers or sports tops uncomfortable, because they tend to interfere with certain body movements and to restrict easy breathing. Also, since such pullovers are not adjustable, except for the stretchability of the fabric itself, they are not satisfactory for those users whose breasts are normally not of the same size, or whose breasts tend to grow in size due to physiological reasons.

In addition, many wearers, after performing an athletic activity, would like to relax and breathe more easily, but are prevented from doing so by the tight-fitting pullover. Unless the athletic woman is prepared to go about with unbound breasts, she must change brassieres which, in some cases, may not be feasible.

SUMMARY OF THE INVENTION

Objects of the Invention

It is a general object of this invention to provide a custom-fit brassiere which has independently adjustable front breast-conforming panels.

Another object of this invention is to provide a user-friendly, front-opening brassiere that opens only from the front.

Still another object of the invention is eliminate struggling with over-the-head, pullover-type, sport tops.

Yet another object of this invention is to enable a brassiere to fit one's breasts no matter whether they are normally of different sizes, or change in size for physiological reasons.

An additional object of the invention is to enable the wearer to tighten or loosen the brassiere for maximum breathing and wearing comfort.

Features of the Invention

In keeping with these objects and others which will become apparent hereinafter, one feature of this invention resides, briefly stated, in a brassiere, which comprises a one-piece, front-opening garment. The garment includes a back panel and a pair of breast-conforming, front panels. The front panels are movable, when worn, into at least a partial overlap at the front of the garment to cover a wearer's breasts to variable extents.

The brassiere further comprises first adjustable support means situated below both front panels and accessible solely at the front of the garment. The first means is operative for adjusting the extent by which one of the front panels covers one of the wearer's breasts.

The brassiere further comprises second adjustable support means situated below both front panels and also accessible solely at the front of the garment. The second means is independently operable of the first adjustable support means, and is operative for adjusting the overlap of the front panels, as well as the extent by which the other of the front panels covers the other of the wearer's breasts.

In accordance with this invention, it does not matter whether the wearer's breasts are normally of different size. It does not matter whether the breasts change in size for any reason. It does not matter whether the wearer just wishes to loosen or tighten the brassiere. In all cases, the size of each breast is separately accommodated, thereby providing for a true custom-fit brassiere with maximum breathing and wearing comfort for the wearer.

User friendliness is achieved by providing that the brassiere solely opens from the front. This feature eliminates struggling with over-the-head, pullover-type sports tops.

In accordance with a preferred embodiment of the brassiere, the back panel and the front panels have a common lower border region, and the garment includes an elastomeric band extending along and secured to the border region. The front panels are also provided with inclined side regions each extending at an acute angle relative to the border region. The garment includes a pair of elastomeric, over-the-shoulder, straps joined together at the back panel. These straps extend individually along the inclined side regions to join the band at respective corner regions of the front panels.

As for the adjustable support means, each includes a hook at the respective corner region of the front panels. The garment has an interior surface facing the wearer when worn, and an opposite exterior surface. The first adjustable support means includes a plurality of first pockets successively arranged in a row along the border region at the interior surface of said other front panel, and a first hook at the exterior surface of the corner region of said one panel. The second adjustable support means includes a plurality of second pockets successively arranged in a row along the border region at the exterior surface of said one front panel, and a second hook at the interior surface of the corner region of said other panel. Each plurality of pockets is formed of a soft, fabric strip having seams spaced apart of one another lengthwise along the border region.

For maximum comfort, each front and back panel is constituted of a double-ply stretchable, breathable fabric such as cotton Lycra (trademark). The band and the straps are formed of rubber. The entire garment is washable. There is no hardware against the wearer's skin, thereby eliminating uncomfortable rubbing or abrasion.

The novel features which are considered as characteristic of the invention are set forth in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
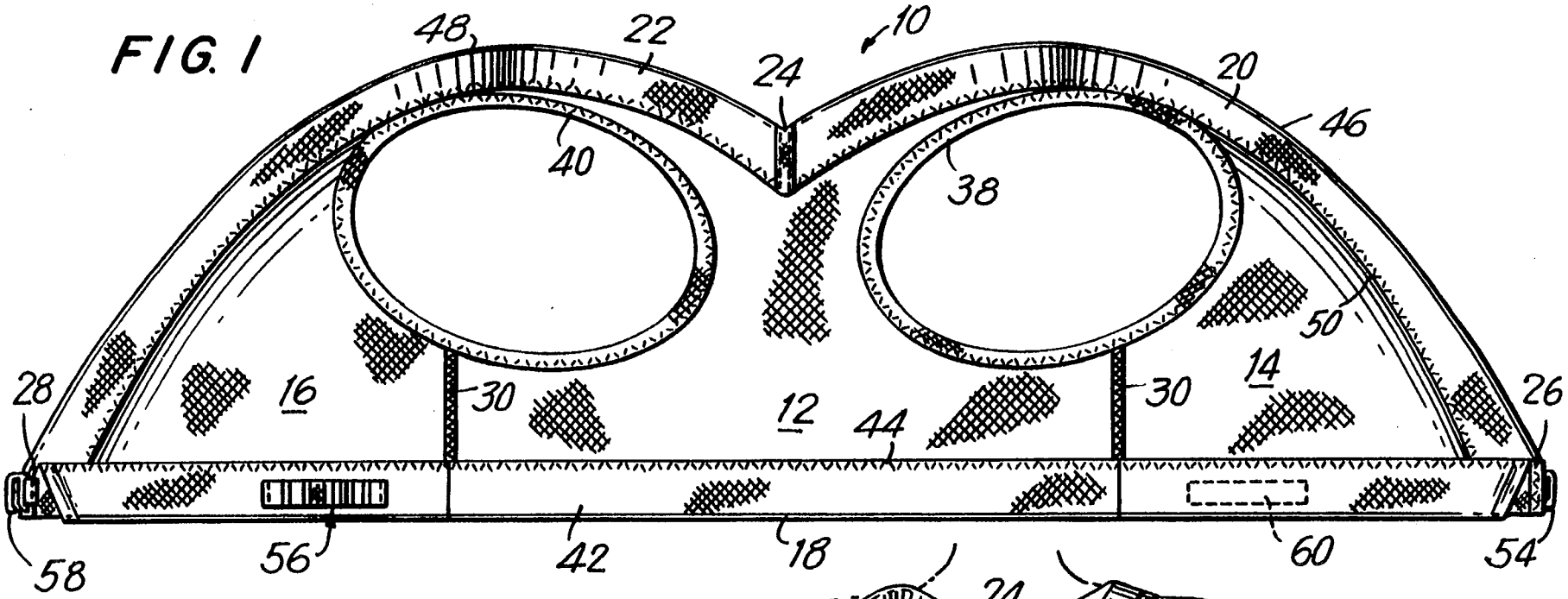
FIG. 1 is a plan view looking at the interior of the brassiere when placed in a flat condition.

Referring now to the drawings, reference numeral 10 generally identified a brassiere or garment of one-piece construction, as seen in plan view looking at the interior side of the garment when placed in a flat condition. Garment 10 includes a back panel 12; a pair of breast-conforming, front panels 14, 16; a common generally horizontal, lower border region 18 extending linearly across the back and front panels; and a pair of arcuate, upper border regions 20, 22 joined together at a cusp 24 on the back panel and extending along curved paths across the back and front panels until they meet the lower border region 18 at corner regions 26, 28, respectively.

Figure 4:
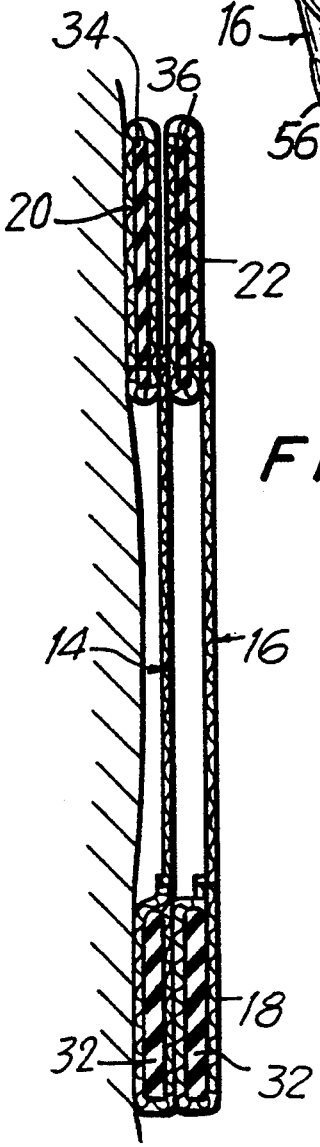
FIG. 4 is an enlarged sectional view taken on line 4—4 of FIG. 3.
Figure 5:
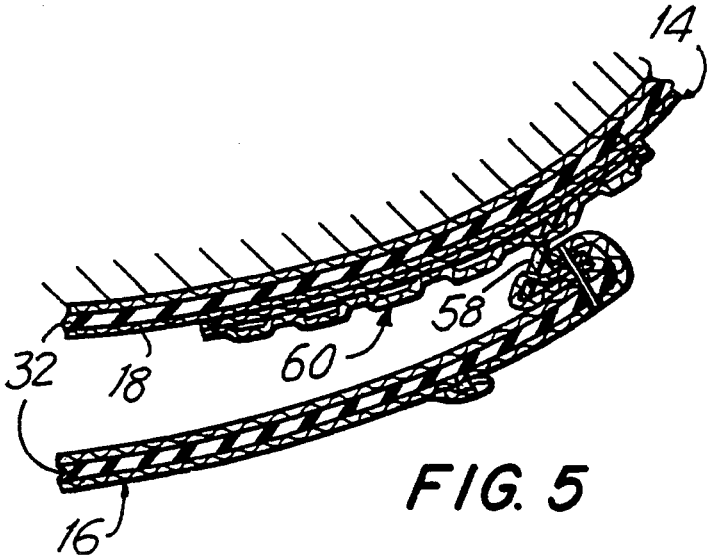
FIG. 5 is an enlarged sectional view taken on line 5—5 of FIG. 3.

The material of the garment is preferably a soft, breathable, stretchable fabric such as a cotton Lycra (trademark). Advantageously the garment material is of double-ply construction. The front panels 14, 16 are stitched to the back panel along upright seams 30 lying perpendicular to the horizontal lower border region 18. An elastomeric ribbon or band 32 (see FIG. 4) is situated between the double-ply fabric of, and extends along, the lower border region 18. A pair of elastomeric straps 34, 36 (see FIG. 4) is situated between the double-ply fabric of, and extends along, the upper border regions 20, 22.

The garment 10 further includes a pair of generally circular arm holes 38, 40 extending through the back and front panels. The circular peripheries of the arm holes are hemmed to prevent unravelling. Similarly, the lower border region 18 has a finished edge 42 formed by folding over a lower marginal region of the back and front panels and sewing the folded-over marginal region at and along seam 44. Analogously, the upper border regions 20, 22 have finished edges 46, 48 formed by folding over upper marginal regions of the back and front panels and sewing the upper marginal regions at and along seams 50, 52.

Garment 10 yet further includes a first adjustable support or fastener having a first hook 54 sewn at the exterior surface of the corner region 26, and a first plurality of pockets 56 sewn at the interior surface of the lower border region 18 of the front panel 16. A second adjustable support or fastener includes a second hook 58 sewn at the interior surface of the corner region 28, and a second plurality of pockets 60 sewn at the exterior surface of the lower border region 18 of the front panel 14. Each plurality of pockets is formed by an elongated fabric strip having a plurality of upright seams sewn therein in spaced apart relationship. Each respective hook is adjustably positioned in a selected one of the respective plurality of pockets.

Figure 2:
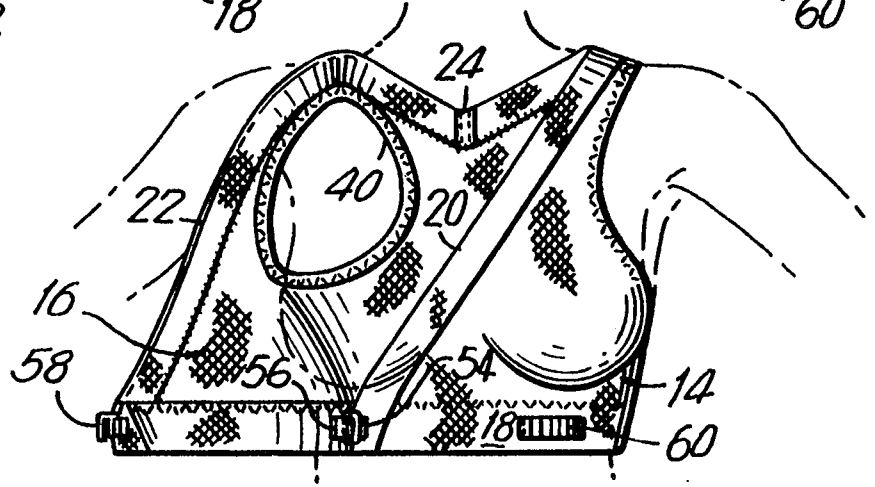
FIG. 2 is a perspective view showing the brassiere in adjusted position on one breast.
Figure 3:
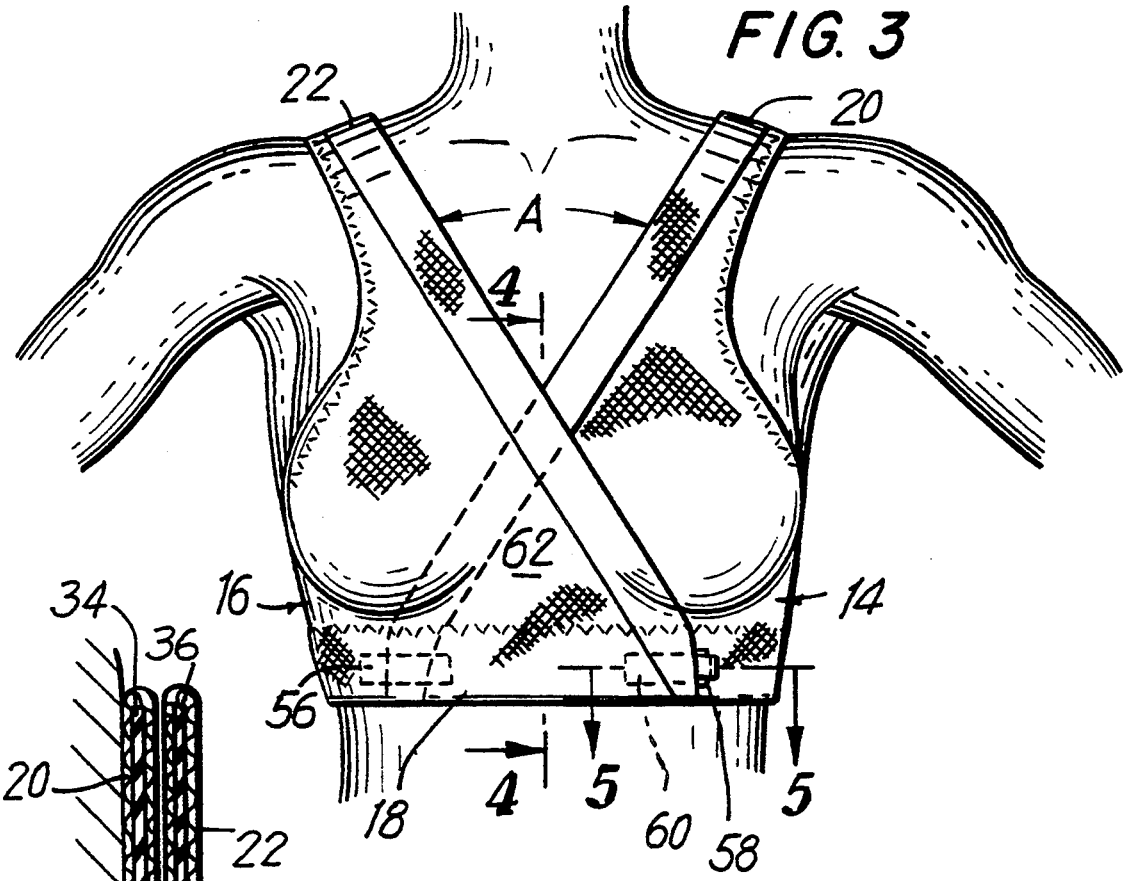
FIG. 3 is a perspective view showing the brassiere in position on both breasts.

In order to put the garment on, the wearer positions her arms through the arm holes 38, 40 in a manner similar to putting on a sleeveless vest. Thus, as shown in FIG. 2, the front panel 14 is moved over the wearer's left breast, and the hook 54 is positioned in a selected one of the pockets 56. Next, as shown in FIG. 3, the front panel 16 is moved over the wearer's right breast, and the hook 58 is positioned in a selected one of the pockets 60. The front panels 14, 16 overlap each other in a central, generally triangular zone 62 at the front of the garment.

Figure 6:
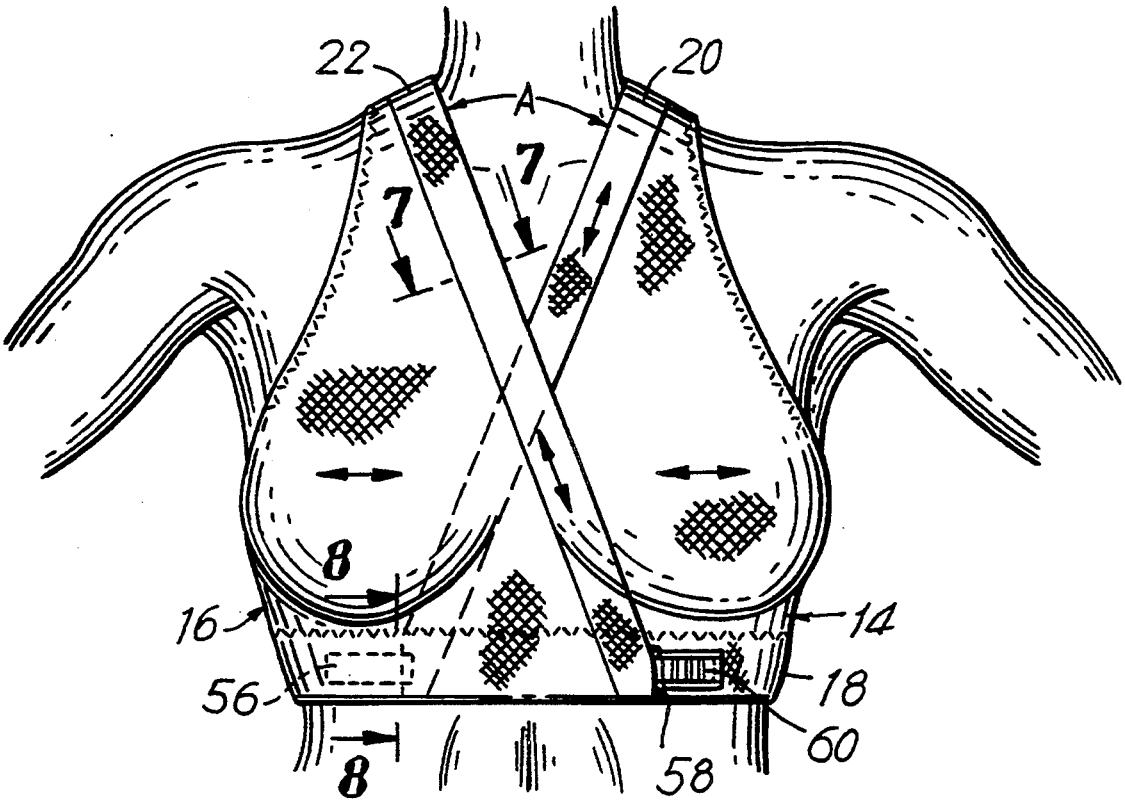
FIG. 6 is a view analogous to FIG. 3, but in a different adjusted position on the wearer's body.
Figure 7:
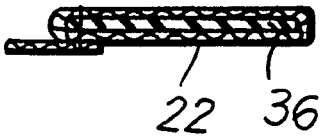
FIG. 7 is an enlarged sectional view taken on line 7—7 of FIG. 6.
Figure 8:
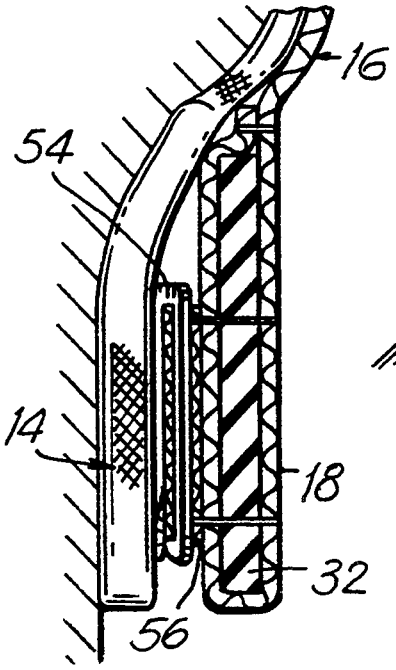
FIG. 8 is an enlarged sectional view taken on line 8—8 of FIG. 6.

The independent selective positioning of the hooks 54, 58 covers the respective breasts to different extents. As best shown in FIG. 6, wherein the hooks are positioned in different pockets for a "looser" fit, the area of the overlap 62 has been changed. These features provide for a true custom fit for each breast, no matter what its original size or size change. The positioning of the hooks and pockets below the front panels 14, 16 at the front of the garment, when worn, along the lower border region, provides easy accessibility for the wearer to independently operate each fastener.

By positioning the hooks at the corner regions, the degree of tensioned support for each breast is likewise independently adjustable. Thus, for example, by moving the hook 58 from its FIG. 3 to its FIG. 6 position, the elastomeric strap 34 in upper border region 22 is moved from a more taut to a more relaxed state, thereby providing less support for the right breast. Not only is the degree of tensioned support adjustable, but simultaneously with the selective positioning of the hooks, the circumferential dimension of the brassiere, i.e., the encirclement around the wearer's rib cage, is adjustable.

Figure 9:
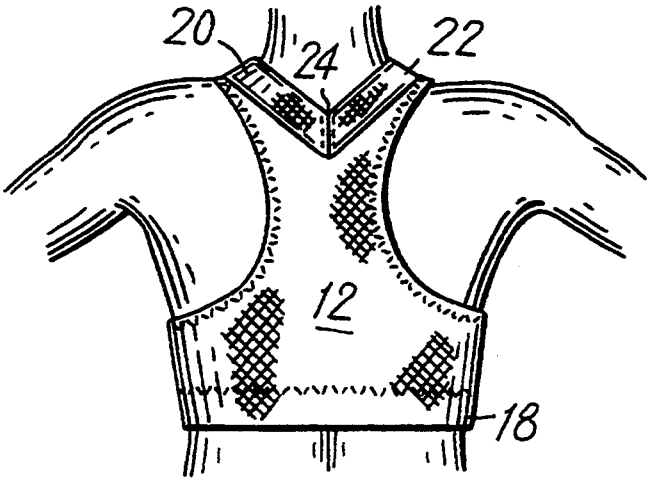
FIG. 9 is a perspective view of the brassiere shown from the back of the wearer.

A comparison of FIGS. 3 and 6 also reveals the angle A included between the upper border regions 20, 22 is likewise adjustable. Thus, the brassiere can be worn under blouses having different necklines. The back of the brassiere is shown in FIG. 9.

Although the above garment has been described in connection with a sports brassiere, it is not intended to be so limited. Thus, the garment in accordance with this invention can be an ordinary brassiere, or a nursing brassiere.

It will be understood that each of the elements described above, or two or more together, also may find a useful application in other types of constructions differing from the types described above.

While the invention has been illustrated and described as embodied in custom-fit, front-opening brassiere, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A brassiere, comprising:

(a) a one-piece, front-opening garment including a back panel and a pair of breast-conforming, front panels, said back panel and the front panels having a common, linear, lower border region, and a pair of arcuate, upper border regions joined together on the back panel and extending to the lower border region to meet at respective corner regions on said front panels, said front panels being movable, when worn, into at least a partial overlap at the front of the garment to cover a wearer's breasts to variable extents;

(b) an elastomeric band extending along and secured to the lower border region;

(c) pair of elastomeric straps each extending along and secured to a respective upper border region;

(d) said front panels having inclined side regions each extending at an arcuate angle relative to the lower border region, and wherein the straps extend individually along the side regions to join the band at said respective corner regions of the front panel;

(e) first adjustable support means situated below both front panels and accessible solely at the front of the garment, for adjusting the extent by which one of the front panels covers one of the wearer's breasts by stretching the band and one of the straps; and (f) second adjustable support means situated below both front panels and also accessible solely at the front of the garment, for adjusting, independently of the first adjustable support means, the overlap of the front panels and the extent by which the other of the front panels covers the other of the wearer's breasts by stretching the band and the other of the straps, thereby custom-fitting the brassiere to the wearer.

2. The brassiere according to claim 1, wherein each adjustable support means includes a hook at a respective corner region.

3. The brassiere according to claim 1, wherein the garment has an interior surface facing the wearer when worn, and an opposite exterior surface; and wherein the first adjustable support means includes a plurality of first pockets successively arranged in a row along the border region at the interior surface of said other front panel, and a first hook at the exterior surface of the corner region of said one panel.

4. The brassiere according to claim 3, wherein the second adjustable support means includes a plurality of second pockets successively arranged in a row along the border region at the exterior surface of said one front panel, and a second hook at the interior surface of the corner region of said other panel.

5. The brassiere according to claim 4, wherein each plurality of pockets is formed of a soft, fabric strip having seams spaced apart of one another lengthwise along the border region.

6. The brassiere according to claim 1, wherein each front and back panel is constituted of a double-ply stretchable, breathable fabric.

7. The brassiere according to claim 1, wherein the garment has generally circular arm holes.

8. The brassiere according to claim 1, wherein the front panels are stitched to the back panel along generally upright side seams extending perpendicularly of the lower border region.

* * * * *